US009306280B2

(12) United States Patent
Kodama et al.

(10) Patent No.: US 9,306,280 B2
(45) Date of Patent: Apr. 5, 2016

(54) MOBILE TERMINAL

(71) Applicant: SONY MOBILE COMMUNICATIONS, INC., Tokyo (JP)

(72) Inventors: Kenichiro Kodama, Tokyo (JP); Aiko Yoshida, Tokyo (JP); Akihiro Bungo, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 0 days.

(21) Appl. No.: 14/594,594

(22) Filed: Jan. 12, 2015

(65) Prior Publication Data

US 2015/0207225 A1 Jul. 23, 2015

Related U.S. Application Data

(62) Division of application No. 13/544,418, filed on Jul. 9, 2012.

(60) Provisional application No. 61/524,916, filed on Aug. 18, 2011.

(51) Int. Cl.
*H01Q 1/24* (2006.01)
*H01Q 3/24* (2006.01)
(Continued)

(52) U.S. Cl.
CPC ..... *H01Q 3/24* (2013.01); *H01Q 1/243* (2013.01); *H01Q 1/52* (2013.01); *H01Q 1/521* (2013.01); *H01Q 21/0006* (2013.01); *H01Q 21/28* (2013.01)

(58) Field of Classification Search
CPC ..... H01Q 1/243; H01Q 3/24
USPC ..... 343/702, 876
See application file for complete search history.

(56) References Cited

U.S. PATENT DOCUMENTS 6,295,462 B1 9/2001 Kudoh
7,046,201 B2 * 5/2006 Okada ..... 343/700 MS
(Continued)

FOREIGN PATENT DOCUMENTS

EP 2 157 660 A1 2/2010
JP 2008-017047 1/2008
(Continued)

OTHER PUBLICATIONS

U.S. Appl. No. 14/594,574, filed Jan. 12, 2015, Kodama, et al.
(Continued)

*Primary Examiner* — Dieu H Duong
(74) *Attorney, Agent, or Firm* — Oblon, McClelland, Maier & Neustadt, L.L.P.

(57) ABSTRACT

A mobile terminal that includes a first antenna element disposed in proximity to a first side of the mobile terminal, a second antenna element disposed in proximity to a second side of the mobile terminal, and a third antenna element disposed in proximity to a third side of the mobile terminal. The mobile terminal further including a switching mechanism that switches between a first connection mode in which the first and second antenna elements are feed elements and the third antenna element is a parasitic element, and a second connection mode in which the first and third antenna elements are feed elements, and a control unit that controls the switching mechanism to switch between the first connection mode and the second connection mode in accordance with a predetermined condition.

5 Claims, 12 Drawing Sheets

(51) Int. Cl.

| | |
|---|---|
| ***H01Q 1/52*** | (2006.01) |
| ***H01Q 21/28*** | (2006.01) |
| ***H01Q 21/00*** | (2006.01) |

(56) References Cited

U.S. PATENT DOCUMENTS

| | | | | |
|---|---|---|---|---|
| 2002/0024469 | A1* | 2/2002 | Masaki | 343/702 |
| 2002/0106995 | A1 | 8/2002 | Callaway, Jr. | |
| 2005/0285810 | A1 | 12/2005 | De Ruijter | |
| 2008/0068271 | A1* | 3/2008 | Iwai et al. | 343/702 |
| 2009/0189824 | A1* | 7/2009 | Nishikido | H01Q 1/242 343/826 |
| 2010/0045557 | A1 | 2/2010 | Park et al. | |
| 2012/0242558 | A1 | 9/2012 | Song et al. | |
| 2012/0299785 | A1* | 11/2012 | Bevelacqua | H01Q 9/42 343/702 |

FOREIGN PATENT DOCUMENTS

| | | | |
|---|---|---|---|
| WO | WO 2004/013935 | A1 | 2/2004 |
| WO | WO 2011/048357 | A1 | 4/2011 |

OTHER PUBLICATIONS

Extended European Search Report issued Apr. 17, 2013, in Patent Application No. 12177866.6.

Lindbert, P., et al., "Improvement of Hearing Aid Compatibility (HAC) of Terminal Antennas using Wavetraps", Laird Technologies, 4 pages.

* cited by examiner

EFFICIENCY OF SIDE ANTENNA →

| FREQUENCY | 0.777 |
|---|---|
| RAD. EFFICIENCY | −2.880 dB |

EFFICIENCY OF SUB ANTENNA →

| FREQUENCY | 0.756 |
|---|---|
| RAD. EFFICIENCY | −4.777 dB |

EFFICIENCY OF MAIN ANTENNA →

| FREQUENCY | 0.756 |
|---|---|
| RAD. EFFICIENCY | −1.255 dB |

MOBILE TERMINAL

CROSS REFERENCE TO RELATED APPLICATION

This application is a divisional of and is based upon and claims the benefit of priority under 35 U.S.C. §120 for U.S. Ser. No. 13/544,418, filed Jul. 9, 2012, the entire contents of which is incorporated herein by reference. U.S. Ser. No. 13/544,418 claims the benefit of priority under 119(e) of U.S. Provisional Patent Application Ser. No. 61/524,916 filed on Aug. 18, 2011.

BACKGROUND

1. Field of the Disclosure

The present disclosure relates to a mobile terminal having an antenna device including a plurality of antennas, and particularly relates to a mobile terminal that can prevent the antenna performance from being degraded when a user holds with a hand the body of the terminal in landscape orientation.

2. Description of Related Art

Some exchange carriers (operators) are now starting a service referred to as long term evolution (LTE) as one of high-speed data-communication specifications of a mobile phone. In antenna technology, LTE has the following features.

Namely, LTE is a communication system referred to as multi input multi output (MIMO), and achieves high-speed data communications by using a plurality of antennas to transmit and receive data. A mobile terminal in MIMO system usually includes two antennas. Ideally, it is desirable that the characteristics of the two antennas be equivalent to each other.

Regarding the antenna characteristics, an indicator referred to as antenna correlation becomes a key point. An increase in the numerical value (coefficient) of the antenna correlation (i.e., an increase in the correlation degree) practically causes a decrease in the antenna gain, and the communication speed is decreased.

Consequently, the correlation between the antennas (correlation coefficient) needs to be decreased. However, it is difficult to satisfy the need in a low frequency band such as the 700 MHz band in view of the terminal size.

As one of the methods of decreasing the correlation coefficient, there is a method of providing a parasitic element referred to as a stub on a side of the terminal.

For example, a multi-antenna, which is less influenced by mutual coupling and applicable to a mobile communication system, is proposed in Japanese Unexamined Patent Application Publication No. 2008-17047. The multi-antenna is provided with a plurality of feed elements which are connected to respective feed points provided on a circuit board, and is provided with one or more parasitic elements which are connected to the circuit board in the vicinity of an arbitrary feed point.

Further, the technique of providing the stub on a side of the terminal to improve hearing aid compatibility (HAC) is described in Japanese Unexamined Patent Application Publication No. 2008-17047.

SUMMARY

Incidentally, (the body of) a mobile terminal is usually held upright (in portrait orientation) during conversation or standby. However, the mobile terminal is increasingly used in a state where the body is held sideways (in landscape orientation) depending on a running application such as game software. In LTE system, typically, a main-antenna is provided on the bottom side of the mobile terminal, and a sub-antenna is on the top side. Therefore, when a user holds the both sides of the mobile terminal in landscape orientation with hands, since the stub is provided on a side area of the terminal as described above, both antennas are affected by the hands. Especially, since the frequency band of the sub-antenna is usually narrower than that of the main-antenna, the performance of the sub-antenna may be significantly degraded when covered by a hand.

The inventors perceive the desirability to prevent from being degraded the antenna performance of a mobile terminal, which has an antenna device including a plurality of antennas, when a user holds the mobile terminal with hands in landscape orientation.

According to a first embodiment, the disclosure is directed to a mobile terminal that includes a first antenna element disposed in proximity to a first side of the mobile terminal, a second antenna element disposed in proximity to a second side of the mobile terminal, and a third antenna element disposed in proximity to a third side of the mobile terminal. The mobile terminal further including a switching mechanism that switches between a first connection mode in which the first and second antenna elements are feed elements and the third antenna element is a parasitic element, and a second connection mode in which the first and third antenna elements are feed elements, and a control unit that controls the switching mechanism to switch between the first connection mode and the second connection mode in accordance with a predetermined condition.

According to another exemplary embodiment, the disclosure is directed to a method performed by a mobile terminal including a first antenna element disposed in proximity to a first side of the mobile terminal, a second antenna element disposed in proximity to a second side of the mobile terminal, and a third antenna element disposed in proximity to a third side of the mobile terminal. The method including switching, by a switching mechanism of the mobile terminal, between a first connection mode in which the first and second antenna elements are feed elements and the third antenna element is a parasitic element, and a second connection mode in which the first and third antenna elements are feed elements; and controlling, by a control unit of the mobile terminal, the switching mechanism to switch between the first connection mode and the second connection mode in accordance with a predetermined condition.

According to a first embodiment, the disclosure is directed to a mobile terminal that includes a first antenna element disposed in proximity to a first side of the mobile terminal, a second antenna element disposed in proximity to a second side of the mobile terminal, and a third antenna element disposed in proximity to a third side of the mobile terminal. The mobile terminal further including means for switching between a first connection mode in which the first and second antenna elements are feed elements and the third antenna element is a parasitic element, and a second connection mode in which the first and third antenna elements are feed elements, and means for controlling the means for switching to switch between the first connection mode and the second connection mode in accordance with a predetermined condition.

According to an embodiment of the present disclosure, when the mobile terminal is held in landscape orientation, the third antenna element which is originally provided as a parasitic element is operated as a sub-antenna in place of the second antenna element which is originally provided as a sub-antenna. Consequently, even though the first sub-antenna is affected by a hand, the second sub-antenna is operated so that an appropriate condition to receive radio waves can be maintained.

BRIEF DESCRIPTION OF DRAWINGS

FIG. 2(*b*) illustrates the mobile terminal of FIG. 1 in landscape orientation and the positions of internal antennas.

DETAILED DESCRIPTION

Hereinafter, preferred embodiments of the present disclosure will be described in detail with reference to the drawings.

Figure 1:
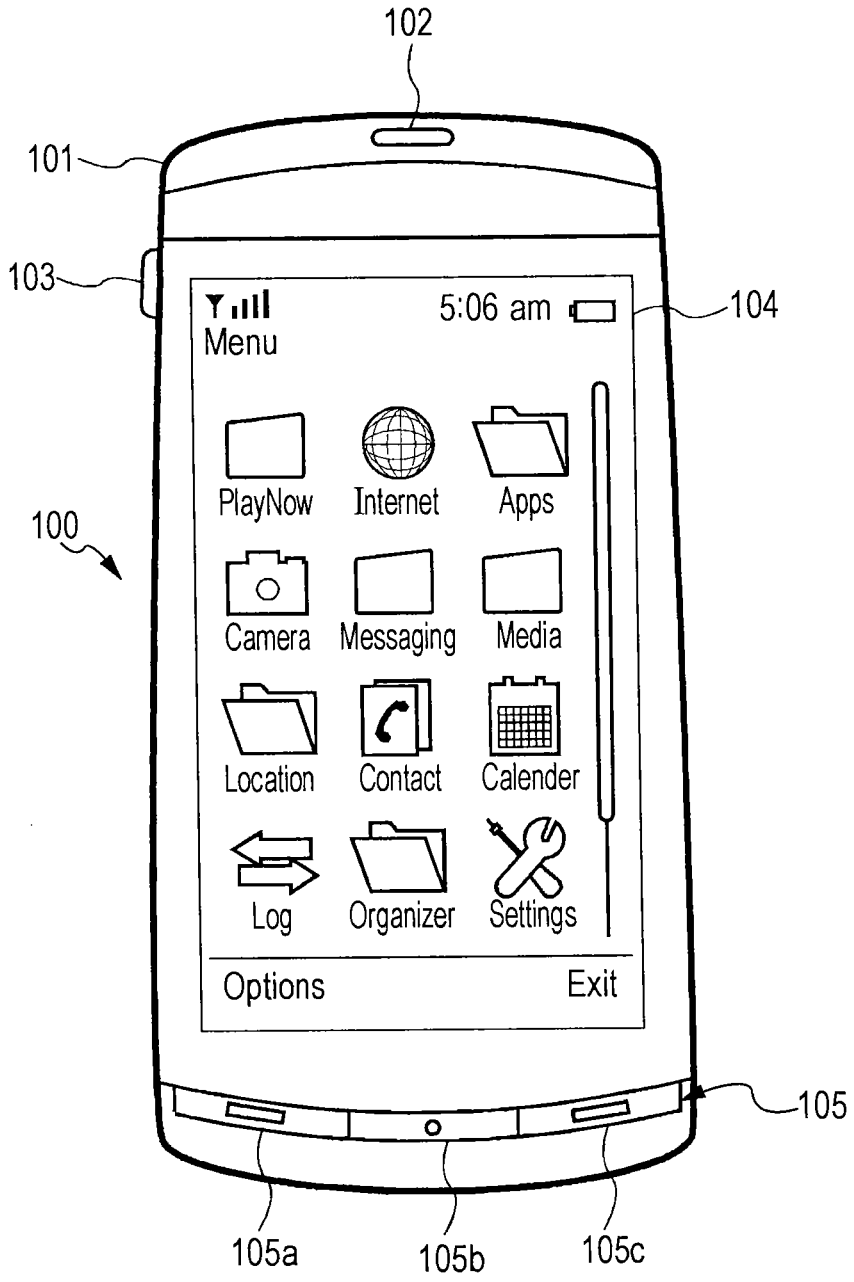
FIG. 1 is an external front view of a mobile terminal in portrait orientation according to an embodiment of the present disclosure.

FIG. 1 is an external front view of a mobile terminal 100 in portrait orientation according to an embodiment of the present disclosure. A sound emitting opening 102 of an ear speaker is provided on a surface of the upper end of a body 101. A display screen 104 is provided on a main area of the surface of the body 101. An operation section 105 including keys 105*a*, 105*b*, and 105*c* is provided on a part below the display screen 104. A side key 103 is provided on a side near the upper end of the body 101. For reference sake, the number, the arrangement, and so forth of the various keys indicated herein are illustrated solely for exemplification, and the present disclosure can be achieved without being limited thereto.

Figure 2A:
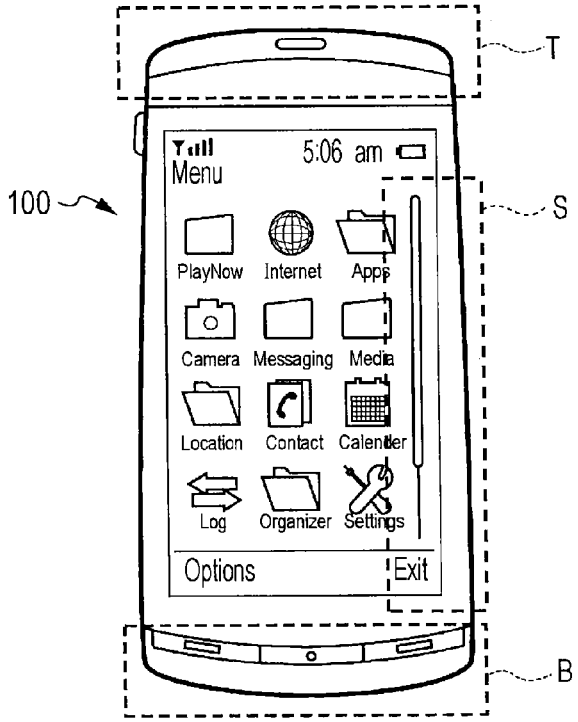
FIG. 2(*a*) illustrates the mobile terminal of FIG. 1 in portrait orientation and the positions of internal antennas.
Figure 2B:
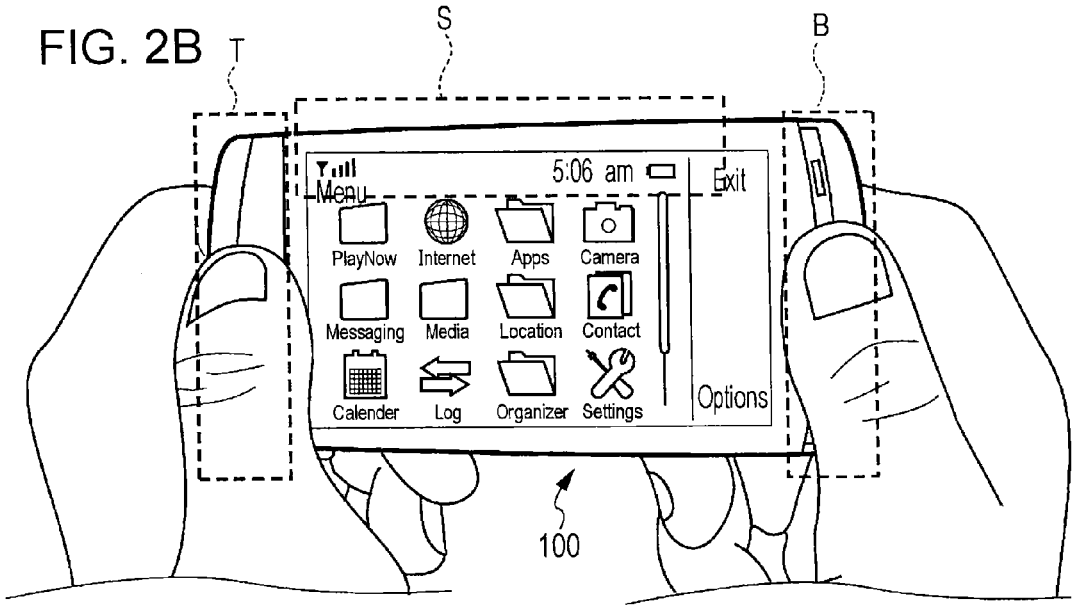

FIG. 2(*a*) is a diagram illustrating the positions of internal antennas of the mobile terminal 100, which is in portrait orientation same as that in FIG. 1. FIG. 2(*b*) illustrates the mobile terminal 100 held by a user with hands in landscape orientation. The user holds both ends of the mobile terminal with both hands.

As described above, in LTE system, typically, a main-antenna is provided on the bottom side B of the mobile terminal, and a sub-antenna is on the top side T. Considering the usage of (the body of) the mobile terminal held in portrait orientation as illustrated in FIG. 2(*a*), a stub is provided on a side area S. When the user holds with hands the both sides of the mobile terminal, since both antennas are affected by the hands, the performance of antennas, especially sub-antenna, is degraded significantly.

Figure 3:
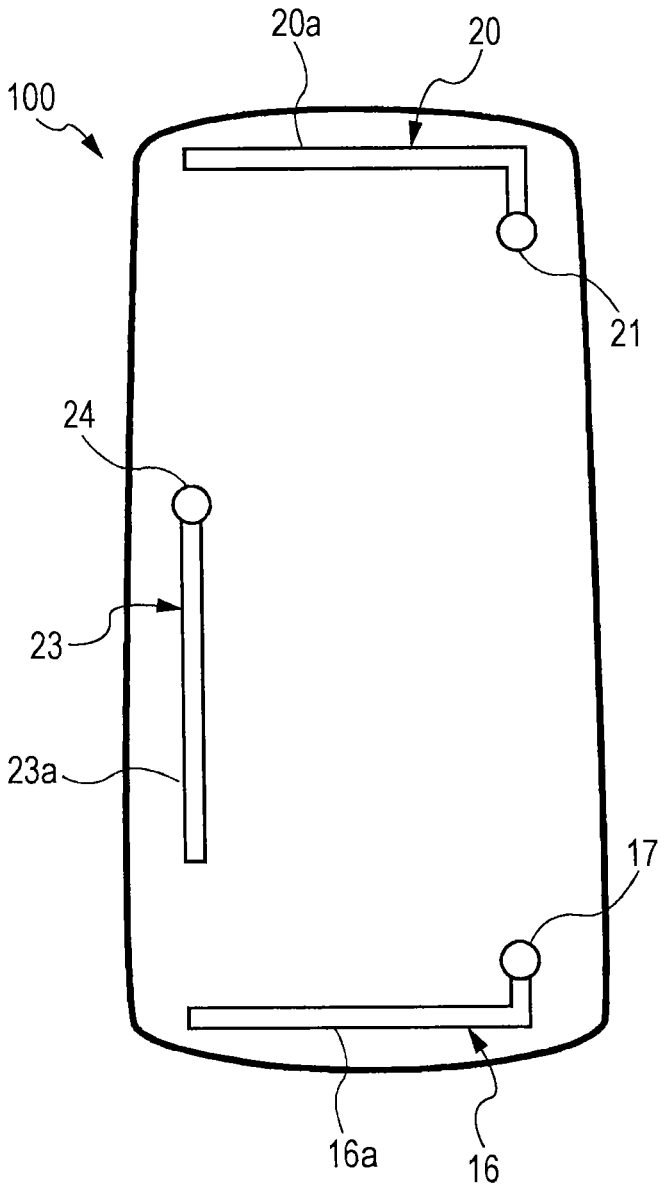
FIG. 3 illustrates the schematic configurations of the antennas in the mobile terminal illustrated in FIG. 1 and an exemplary arrangement thereof.

FIG. 3 illustrates the schematic configurations of the antennas in the mobile terminal 100 and an exemplary arrangement thereof. The diagram illustrates the rear side of the mobile terminal 100 in FIG. 1. A main-antenna (feed element) 16 serving as a first antenna is arranged along the edge of the lower end of the mobile terminal 100 which is in portrait orientation. An end of a first antenna element 16*a* of the main-antenna 16 is connected to a feed point 17. A sub-antenna 20 (feed element) is arranged along the edge of the upper end. An end of a second antenna element 20*a* of the sub-antenna 20 is connected to a feed point 21. Thus, the first and second antenna elements 16*a* and 20*a* are respectively arranged in the vicinity of two opposite short sides of the mobile terminal 100 having a substantially rectangular shape.

Further, a stub 23 (parasitic element) is arranged near a long side of the mobile terminal 100, specifically, along the long side in this example. An end of a third antenna element 23*a* of the stub 23 is connected to a GND point 24. The shapes, the sizes, the arrangement, and so forth of these antenna elements are illustrated solely for exemplification, and the present disclosure can be achieved without being limited thereto.

Figure 4:
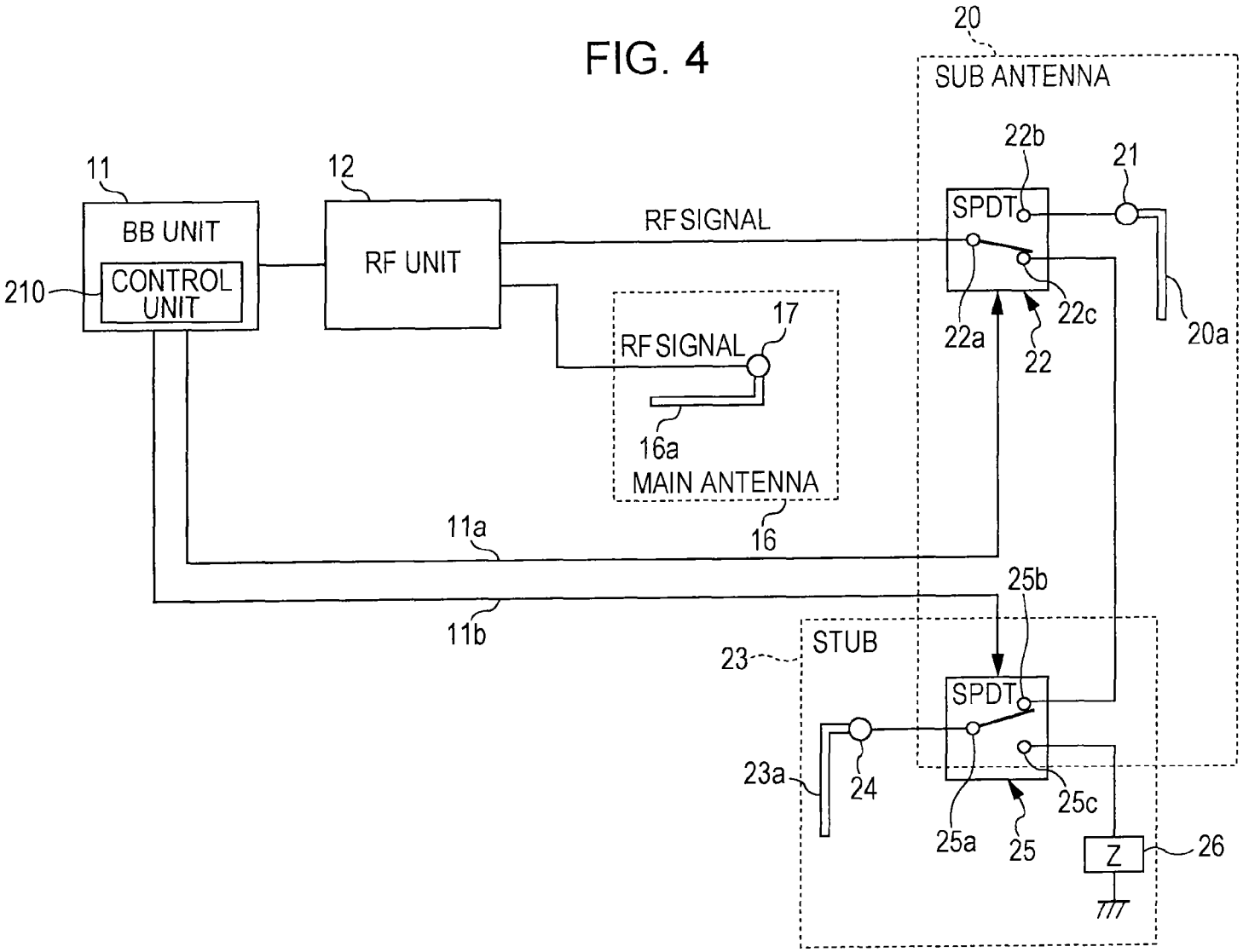
FIG. 4 illustrates a schematic configuration of a circuit of the mobile terminal including antenna circuits and a device controlling the antenna circuits according to the embodiment of the present disclosure.

FIG. 4 illustrates a schematic configuration of a circuit of the mobile terminal including antenna circuits and a device controlling the antenna circuits according to the present embodiment.

The feed point 17 of the first antenna element 16*a* of the main-antenna 16 is connected to an RF unit 12 which is a high frequency circuit. The feed point 21 of the second antenna element 20*a* of the sub-antenna 20 is also connected to the RF unit 12.

The GND point 24 of the third antenna element 23*a* of the stub 23 is connected to an SPDP switch 25. A terminal 25*c* of the switch 25 is grounded via a matching circuit 26 having specified impedance (z). The switch 25 selectively connects a terminal 25*a*, which is wired to the GND point 24, to a grounded terminal 25*c* or a terminal 25*b*, which is wired to (a terminal 22*c* of) the switch 22.

In the present embodiment, the switches 22 and 25 are included in a switching mechanism. The switching mechanism that switches modes between a first connection mode where the first and second antenna elements 16*a* and 20*a* serve as feed elements and the third antenna element 23*a* serves as a parasitic element and a second connection mode where the first and third antenna elements 16*a* and 23*a* serve as feed elements.

The switching of the switch 22 and the switch 25, which are included in the switching mechanism, are operated together by a control unit (controller) 210, which will be described later, in accordance with a specified condition so that the switching between the first connection mode and the second connection mode is done.

The RF unit 12 is a part that converts signals between a baseband signal and an RF signal. Specifically, the RF unit 12 performs processing such as modulation and power amplification of signals to be transmitted, and amplification and demodulation of received signals.

A baseband unit 11 includes a control unit 210 that performs baseband signal processing such as encoding of a signal to be transmitted, decoding of a received signal, processing of various data; and operates the switches 22 and 25. The control unit 210 operates the switch 22 to connect to terminal 22*b* (that is, the feed point 21) based on a switch-control signal 11*a*, and operates the switch 25 to connect to terminal 25*c* (the ground point) based on a switch-control signal 11*b* in portrait orientation mode. Accordingly, the antenna element 20*a* of the sub-antenna 20 is connected to the feed point 21, and the antenna element 23*a* of the stub 23 is grounded via the matching circuit 26.

In landscape orientation mode, the switch 22 is operated to connect to the terminal 22*c* (that is, the switch 25) based on the switch-control signal 11*a* while the switch 25 is operated to connect to the terminal 25*b* (the switch 22) based on the switch-control signal 11*b*. Accordingly, the feed point 21 of the antenna element 20*a* of the sub-antenna 20 is disconnected from the terminal 22*a*, and the terminal 22*a* is connected to the switch 25. The antenna element 23*a* of the stub 23 is connected to the RF unit 12 via the switch 25 and the switch 22. That is, the connection point 24 of the stub 23 becomes another feed point, and the antenna element 23*a* of the stub 23, which is the parasitic element in ordinary time, functions as a feed element in landscape orientation mode. Incidentally, although the switched-control signal 11*a* and the switch-control signal 11*b* are illustrated as signals travelling in the different two lines, a single line may be used.

Figure 5:
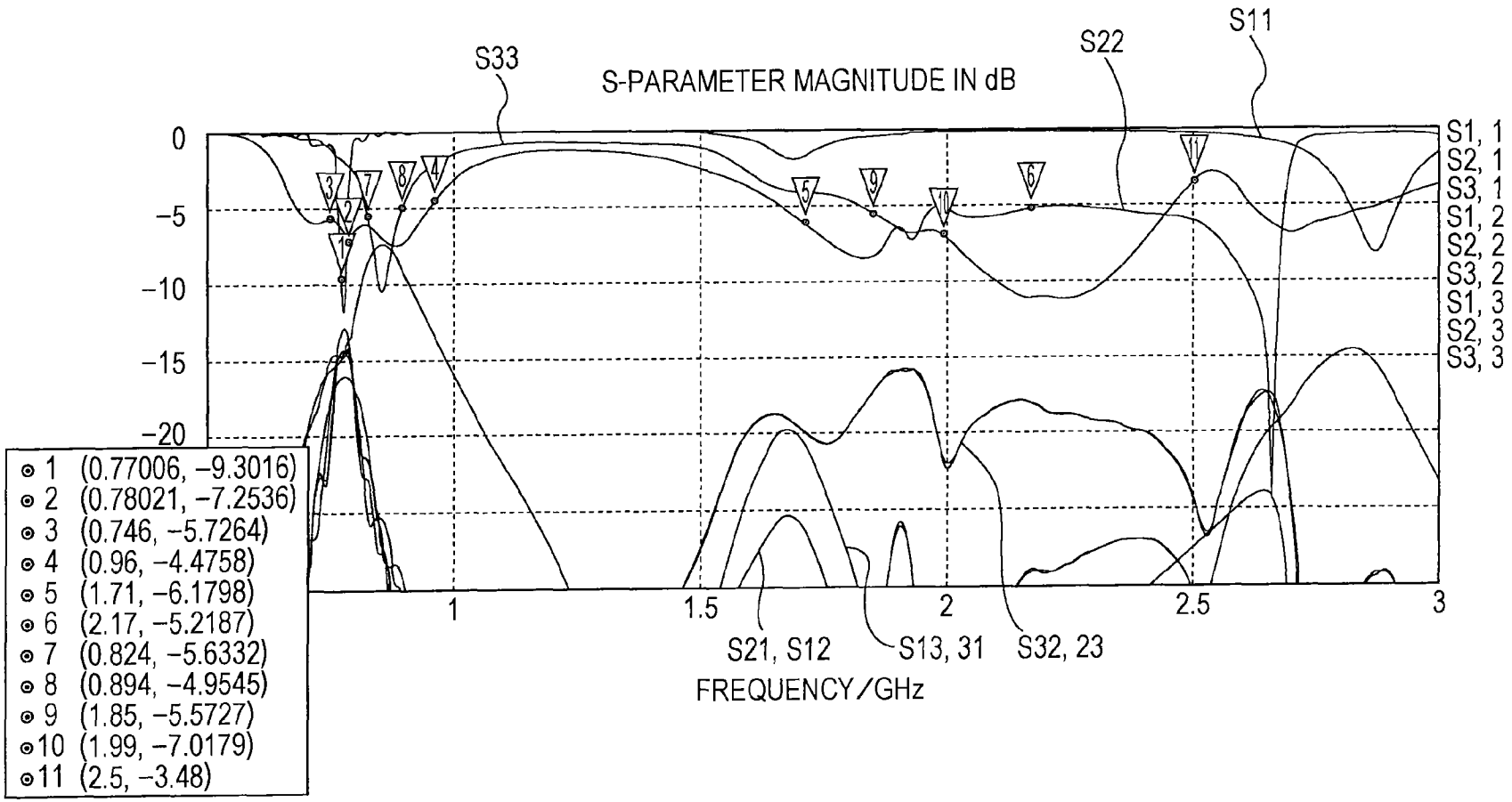
FIG. 5 is a graph of S-parameters showing frequency characteristics of an antenna device according to the embodiment of the present disclosure.

The frequency characteristics of S-parameters of antennas in an antenna device of the present embodiment are illustrated in FIG. 5. The line S11 represents the reflection property of the antenna, which is obtained when the stub 23 functions as an antenna (side antenna) in the second connection mode. The line S22 represents the reflection property of the main-antenna, which is obtained in the first or second connection mode. The line S33 represents the reflection property of the sub-antenna, which is obtained in the first connection mode. A list in the lower left frame of the drawing shows the S-parameter magnitudes in dB value measured under frequencies indicated by points 1 to 11. In the stub 23 functioning as a side antenna in the second connection mode, resonance occurs at about 700 MHz as is the case with the main-antenna and sub-antenna, which exhibits that the side antenna can function as the sub-antenna.

The lines S21 and S12 in FIG. 5 illustrate isolation characteristics between the main-antenna and the side antenna in the second connection mode. The line S21 falls along the line S12. The lines S13 and S31 illustrate isolation characteristics between the side antenna and the sub-antenna in the second connection mode. The line S13 falls along the line S31. The lines S23 and S32 illustrate isolation characteristics between the main-antenna and the sub-antenna in the first connection mode. The line S23 falls along the line S32.

Figure 6:
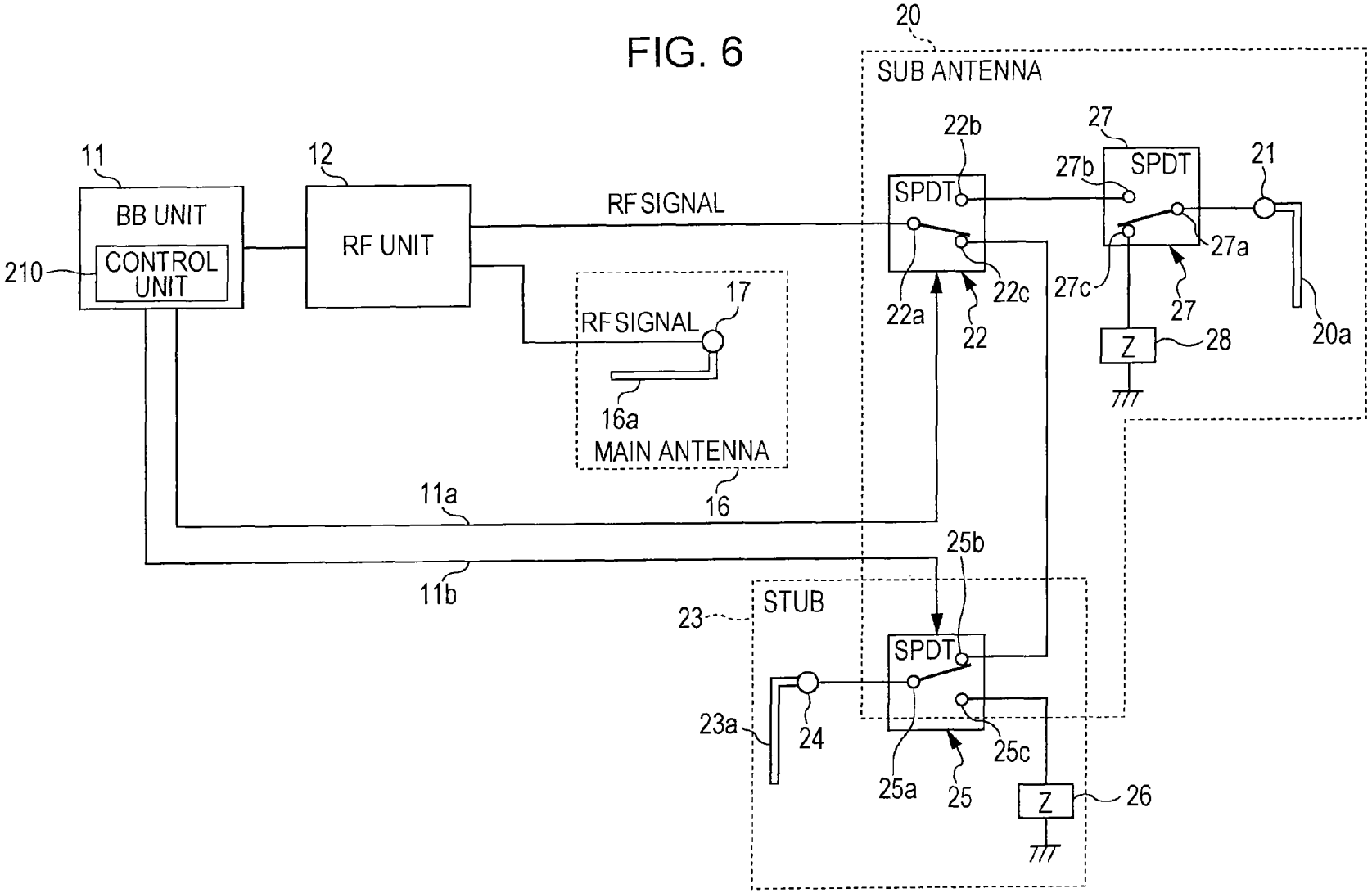
FIG. 6 illustrates an exemplary modification of the circuit illustrated in FIG. 4.

FIG. 6 illustrates an exemplary modification of the device of FIG. 4. The same elements as the elements illustrated in FIG. 4 are designated by the same reference numerals and the redundant descriptions are omitted. According to the exemplary modification, the feed point 21 is not opened in the second connection mode, but is grounded (that is, terminated) via a matching circuit 28 having specified impedance (z) by an SPDP switch 27. Accordingly, the terminal 22*b* of the switch 22 is connected to a terminal 27*b* of the switch 27, and a terminal 27*c* of the switch 27 is grounded via the matching circuit 28. A terminal 27*a* of the switch 27 is connected to the feed point 21 of the antenna element 20*a*. The antenna characteristics of the exemplary modification can be stabilized as compared to that of the configuration where the feed point 21 is floated in the second connection mode.

Figure 7:
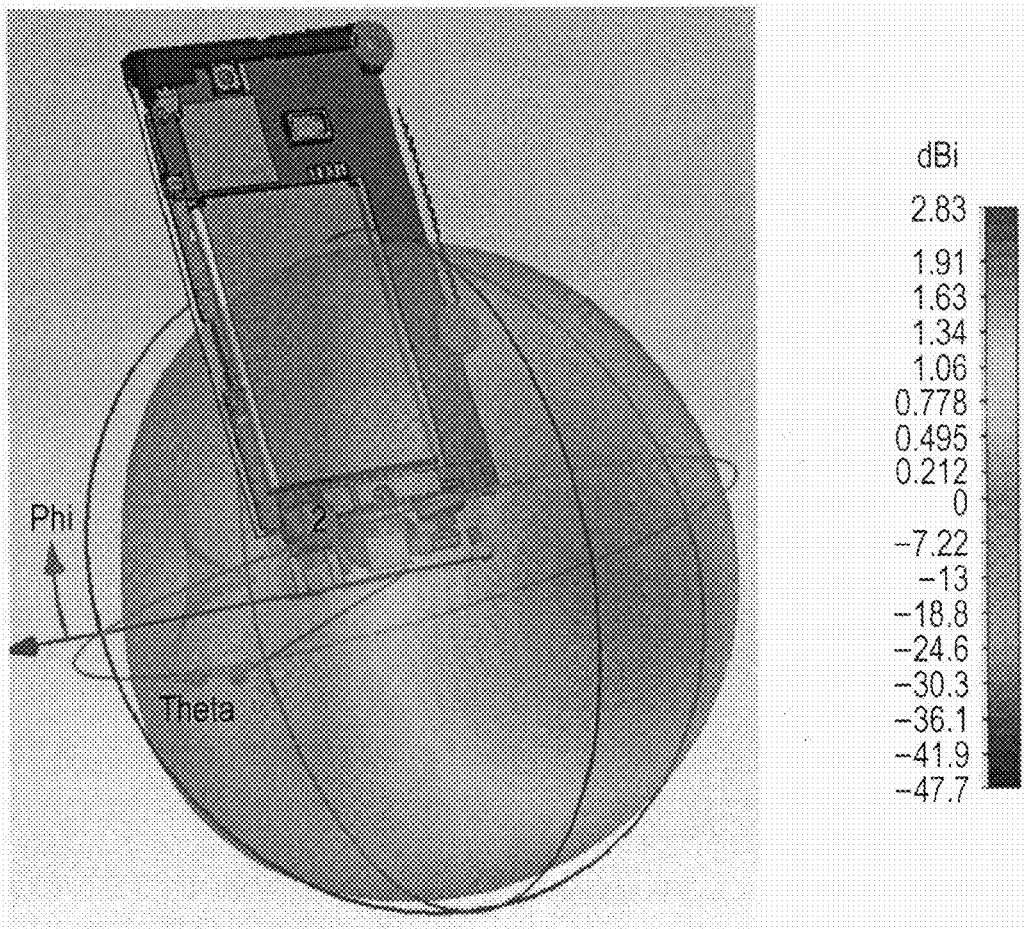
FIG. 7 is a diagram which schematically illustrates in a gray scale a three-dimensional radiation pattern of the side antenna, or the stub, in the second connection mode according to the embodiment of the present disclosure.

FIG. 7 is a diagram which schematically illustrates in a gray scale a three-dimensional radiation pattern of a side antenna, or a stub 23, in the second connection mode. The antenna efficiency of the side antenna is −2.880 dB at a frequency of 0.777 GHz, which causes no particular problems. The antenna efficiency described herein denotes the radiation efficiency of an antenna provided in free space.

Figure 8:
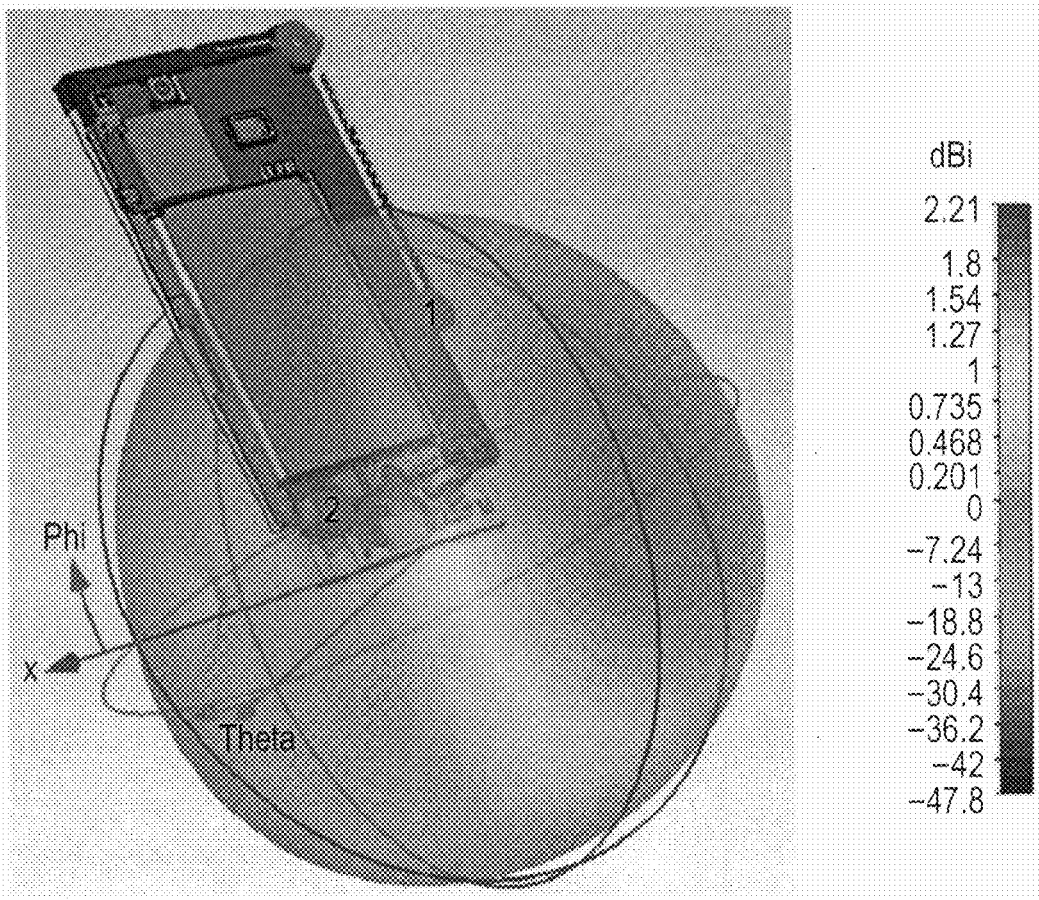
FIG. 8 is a diagram which schematically illustrates in a gray scale a three-dimensional radiation pattern of the sub-antenna in the first connection mode according to the embodiment of the present disclosure.

FIG. 8 is a diagram which schematically illustrates in a gray scale a three-dimensional radiation pattern of a sub-antenna in the first connection mode, for comparison to FIG. 7. The antenna efficiency of the sub-antenna is −4.777 dB at a frequency of 0.756 GHz.

Figure 9:
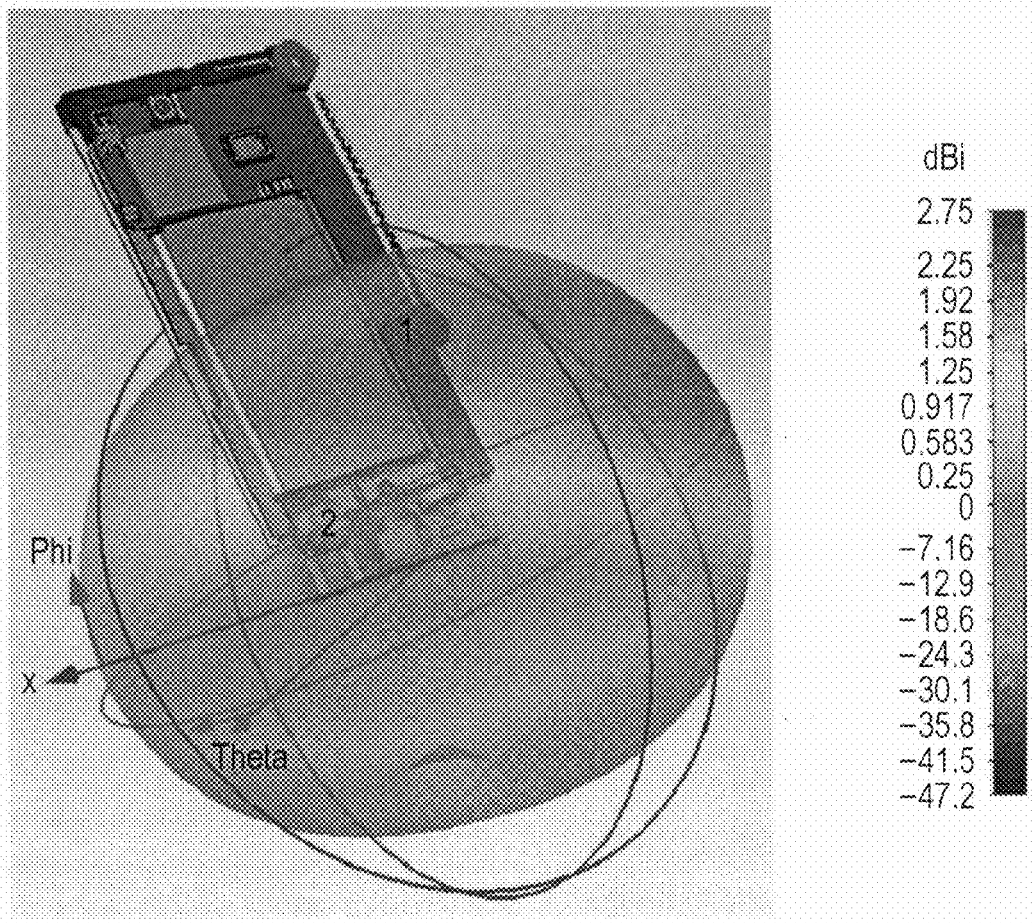
FIG. 9 is a diagram which schematically illustrates in a gray scale a three-dimensional radiation pattern of the main-antenna in the first or second connection mode according to the embodiment of the present disclosure.

FIG. 9 is a diagram which schematically illustrates in a gray scale a three-dimensional radiation pattern of a main-antenna in the first or second connection mode, for reference purposes. The antenna efficiency of the main-antenna is −1.255 dB at a frequency of 0.756 GHz.

Incidentally, the mobile terminal is illustrated with the radiation pattern in FIGS. 7 to 9 to explain the correspondence relation between the radiation pattern and the coordinate system of the mobile terminal, but not to explain the positional relation between the feed point of each antenna and the center of the radiation pattern. Incidentally, the antenna device illustrated in FIG. 3 has the stub arranged at the opposite side to a side where both of the feed points feeding the main-antenna and the sub-antenna are arranged. On the contrary, the antenna device illustrated in FIGS. 7 to 9 has the stub arranged at the same side of the side where both of the feed points are arranged. However, the inventors confirmed that the effect of the present disclosure can be attained through either of the arrangements.

Figure 10:
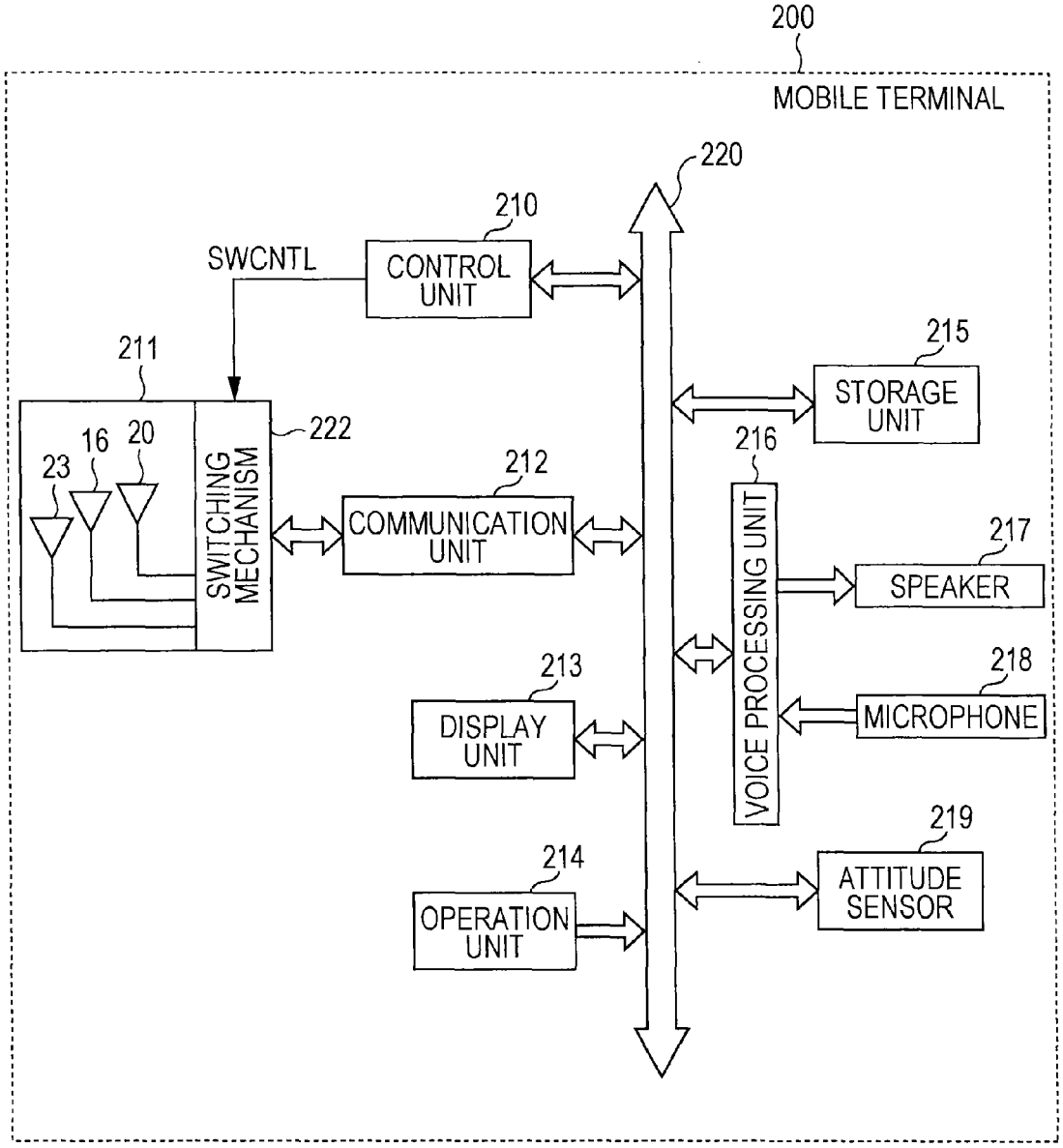
FIG. 10 illustrates an exemplary configuration of the mobile terminal including the antenna device according to the embodiment of the present disclosure.
Figure 11A:
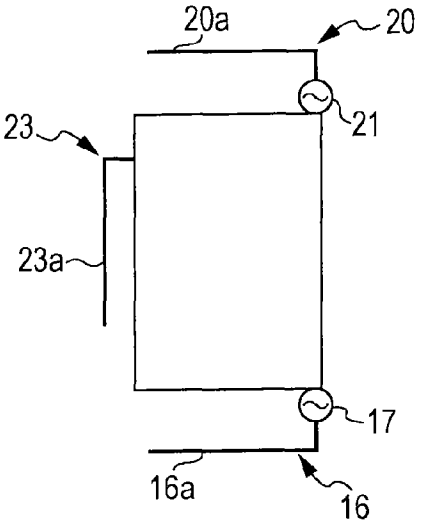
FIGS. 11(*a*) to 11(*h*) illustrate exemplary modifications of the embodiment of the present disclosure.
Figure 11B:
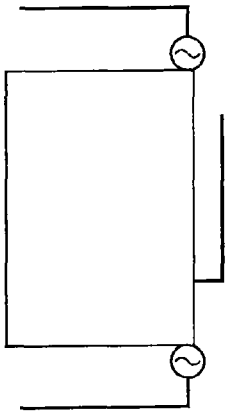
Figure 11C:
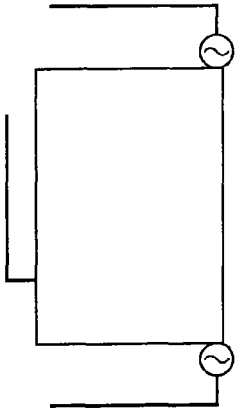
Figure 11D:
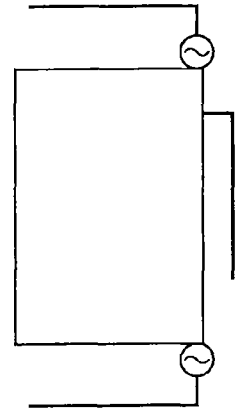
Figure 11E:
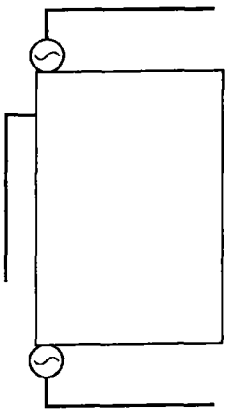
Figure 11F:
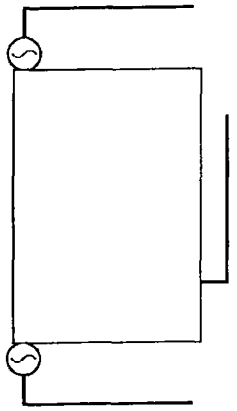
Figure 11G:
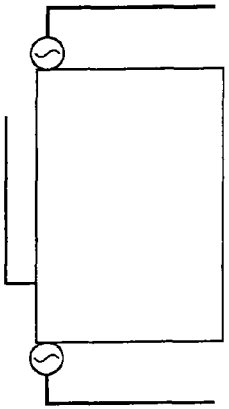
Figure 11H:
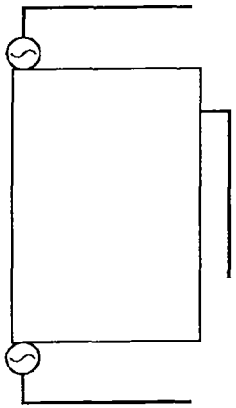
Figure 12A:
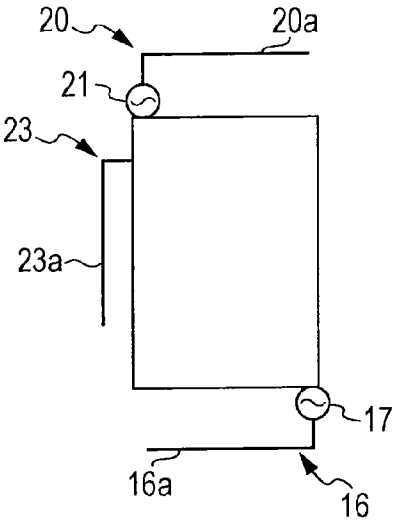
FIGS. 12(*a*) to 12(*h*) illustrate other exemplary modifications of the embodiment of the present disclosure.
Figure 12B:
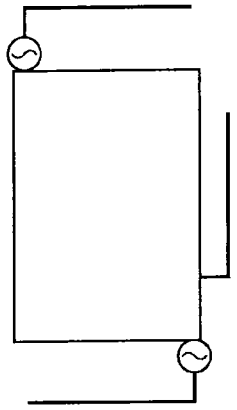
Figure 12C:
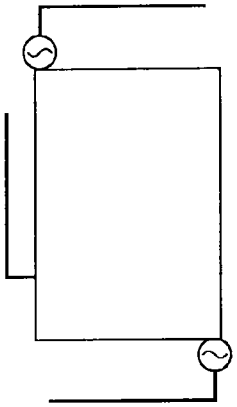
Figure 12D:
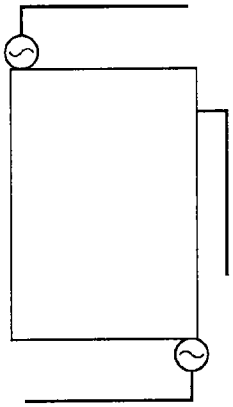
Figure 12E:
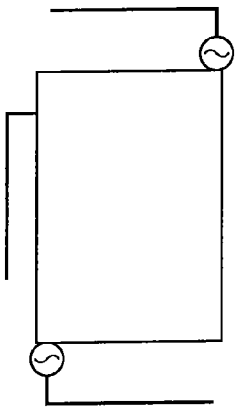
Figure 12F:
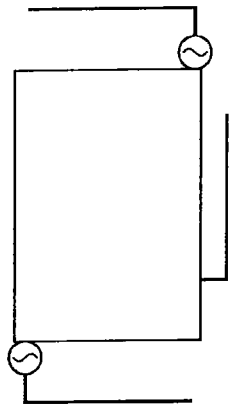
Figure 12G:
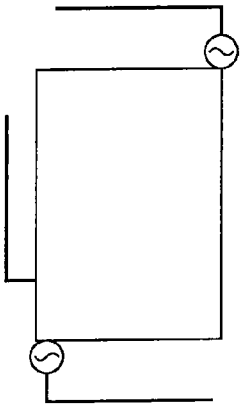
Figure 12H:
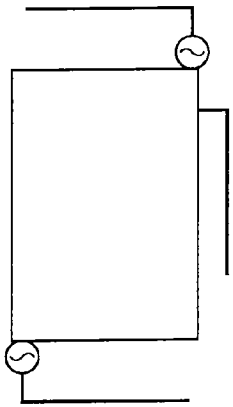

FIG. 10 illustrates an exemplary configuration of a mobile terminal 200 including the antenna device according to the above-described embodiment.

The mobile terminal 200 includes a control unit 210, an antenna device 211, a communication unit 212, a display unit 213, an operation unit 214, a storage unit 215, a voice processing unit 216, a speaker 217, a microphone 218, and an attitude sensor 219. The control unit 210 is a part connected to each unit via a bus 220 to perform control of each unit and necessary data processing, and includes a processor such as a CPU. The communication unit 212 is a part performing wireless communications with a base station or the like by radio waves via the antenna device 211, and includes the above-described RF unit 12. The antenna device 211 includes a plurality of antennas 16 and 20, the stub 23, and a switching mechanism 222 to perform MIMO transfer as described above. The switching mechanism 222 includes the switch 22 and the switch 25 (and the switch 27). A switch-control signal SWCNTL is supplied from the control unit 210 to the switching mechanism 222. The switch-control signal SWCNTL is turned ON/OFF in accordance with a specified condition. In the present embodiment, OFF corresponds to the ordinary time (the portrait orientation mode) and ON corresponds to the non-ordinary time (the landscape orientation mode).

The attitude sensor 219 can detect the attitude of the mobile terminal 200, and in particular can determine whether the body 101 is currently placed in portrait orientation or in landscape orientation. For the above-described attitude sensor, an acceleration sensor can be used, for example. In another case, a thermal sensor arranged in a specified position to detect the body temperature of a user can be used. Further, the control unit 210 may control the switching mechanism 222 in accordance with the type of a currently executed application or the execution state of the application instead of using the attitude sensor 219. For example, when a specified application needs to be operated in landscape orientation mode, the control unit 210 selects a landscape orientation mode in which the switch-control signal SWCNTL is ON. In another case, when an event requiring a temporarily operation in landscape orientation mode occurs during execution of an application, the control unit 210 may temporarily select a landscape orientation mode in which the control signal SWCNTL is ON.

The display unit 213 is a part that provides a display interface for the user and includes a display device, which displays information on its screen such as an LCD or an organic EL display. The operation unit 214 is a part that provides an input interface for the user and has an input device such as numeric keys, various control keys. The storage unit 215 is a part that stores an OS and various application programs including a communication application program or the like as programs to be executed by the control unit 210, and necessary data; and includes a memory device such as a ROM and RAM. The voice processing unit 216 is a part that processes received voice data, voice data in a video file, and music data; has a codec device or the like; and is connected to the speaker 217 outputting voice, the microphone 218 collecting voices to be transmitted, and the like.

FIGS. 11(*a*) to 11(*h*) illustrate exemplary modifications of an embodiment of the present disclosure. Those drawings illustrate exemplary different combinations of adoptable arrangements of the stub and adoptable directions in which the stub extends from its GND point, when both of the feed points of the main-antenna and the sub-antenna are arranged at the same side of the mobile terminal. FIG. 11(*a*) corresponds to the configuration illustrated in FIG. 3. Any of these configurations allows for an appropriate effect.

FIGS. 12(*a*) to 12(*h*) illustrate other exemplary modifications of an embodiment of the present disclosure. These configurations illustrate exemplary different combinations of adoptable arrangements of the stub and adoptable directions in which the stub extends from its GND point, when both of the feed points of the main-antenna and the sub-antenna are arranged at the opposite sides of the mobile terminal. Any of these configurations allows for an appropriate effect.

Thus, preferred embodiments of the present disclosure have been described. However, various modifications and changes may be made other than those stated above. Namely, it is taken for granted by a person skilled in the art that various alterations, combinations, and another embodiment may occur by the design or other elements within the scope of Claims or the same scope as that of Claims.

For example, in the above-described embodiments, the MIMO transfer is exemplarily performed through the use of the plurality of antennas. However, the embodiments can also be applied to the case where diversity reception is performed.

In the above-described embodiments of the present disclosure, a mobile terminal including:

a first antenna element and a second antenna element that are respectively arranged in the vicinity of two opposite short sides of the mobile terminal;

a third antenna element arranged in the vicinity of a long side of the mobile terminal;

a switching mechanism that switches modes between a first connection mode where the first and second antenna elements serve as feed elements and the third antenna element serves as a parasitic element and a second connection mode where the first and third antenna elements serve as feed elements; and a control unit that causes the switching mechanism to switch modes between the first connection mode and the second connection mode in accordance with a specified condition is described.

Further, the mobile terminal further including a sensor that determines whether or not the mobile terminal is currently in landscape orientation, wherein the control unit controls the switching mechanism in accordance with an output of the sensor as the specified condition, is described.

Further, the mobile terminal, wherein the control unit controls the switching mechanism in accordance with the type of a currently executed application, or in accordance with the execution state of the application as the specified condition, is described.

Further, the mobile terminal further including a matching circuit arranged between the third antenna element and a GND point in the first connection mode is described.

Further, the mobile terminal further including a matching circuit arranged between the second antenna element and a GND point in the second connection mode is described.

Further, the mobile terminal performing MIMO transfer by using the first antenna element and the second or third antenna element is described.

Further, the mobile terminal performing diversity reception by using the first antenna element and the second or third antenna element is described.

The invention claimed is:

1. A mobile terminal comprising:

a first antenna element disposed in proximity to a first side of the mobile terminal;

a second antenna element disposed in proximity to a second side of the mobile terminal;

a third antenna element disposed in proximity to a third side of the mobile terminal;

a radio frequency circuit including a first input terminal and a second input terminal, the first input terminal being electrically coupled with the first antenna element, and the radio frequency circuit being configured to convert radio frequency signals received at the first input terminal and the second input terminal to a baseband signal;

a switch that includes a first connection mode in which the second antenna element is electrically coupled with the second input terminal of the radio frequency circuit and the third antenna element is electrically decoupled from the second input terminal of the radio frequency circuit, and a second connection mode in which the third antenna element is electrically coupled with the second input terminal of the radio frequency circuit and the second antenna element is electrically decoupled from the second input terminal of the radio frequency circuit; and circuitry configured to determine an orientation of the mobile terminal, the orientation being associated with a type of an application currently executed by the mobile terminal; and set the switch to the first connection mode or the second connection mode based on the determined orientation of the mobile terminal.

2. The mobile terminal of claim 1, wherein, in the first connection mode, the switch connects the third antenna element to a matching circuit arranged between the third antenna element and a ground point.

3. The mobile terminal of claim 1, wherein, in the second connection mode, the switch connects the second antenna element to a matching circuit arranged between the third second antenna element and a ground point.

4. The mobile terminal of claim 1, wherein the switch comprises:

a matching circuit;

a first switching circuit including a first terminal, a second terminal, and a common terminal, the first terminal being electrically coupled with the second antenna element, and the common terminal being electrically coupled with the second input terminal of the radio frequency circuit; and a second switching circuit including a first terminal, a second terminal, and a common terminal, the first terminal being electrically coupled with the second terminal of the first switching circuit, the second terminal being electrically coupled with the matching circuit, and the common terminal being electrically coupled with the third antenna element.

5. The mobile terminal of claim 1, wherein the switch comprises:

a first matching circuit;

a second matching circuit;

a first switching circuit including a first terminal, a second terminal, and a common terminal, the common terminal being electrically coupled with the second input terminal of the radio frequency circuit;

a second switching circuit including a first terminal, a second terminal, and a common terminal, the first terminal being electrically coupled with the first terminal of the first switching circuit, the second terminal being electrically coupled with the first matching circuit, and the common terminal being electrically coupled with the second antenna element; and a third switching circuit including a first terminal, a second terminal, and a common terminal, the first terminal being electrically coupled with the second terminal of the first switching circuit, the second terminal being electrically coupled with the second matching circuit, and the common terminal being electrically coupled with the third antenna element.

* * * * *